US012576445B2

(12) United States Patent
Han

(10) Patent No.: US 12,576,445 B2
(45) Date of Patent: Mar. 17, 2026

(54) CASTING PROCESS FOR MAKING AN EROSION AND WEAR RESISTANT SHOT CHAMBER FOR DIE CASTING APPLICATIONS

(71) Applicant: Qingyou Han, Stow, OH (US)

(72) Inventor: Qingyou Han, Stow, OH (US)

( * ) Notice: Subject to any disclaimer, the term of this patent is extended or adjusted under 35 U.S.C. 154(b) by 0 days.

(21) Appl. No.: 18/959,750

(22) Filed: Nov. 26, 2024

(65) Prior Publication Data

US 2025/0345846 A1 Nov. 13, 2025

Related U.S. Application Data

(62) Division of application No. 18/094,469, filed on Jan. 9, 2023, now Pat. No. 12,194,528.

(51) Int. Cl.

| | |
|---|---|
| ***B22D 19/00*** | (2006.01) |
| ***B22D 17/20*** | (2006.01) |
| ***B22D 17/22*** | (2006.01) |
| ***C23C 28/00*** | (2006.01) |

(52) U.S. Cl.

CPC ..... *B22D 17/2023* (2013.01); *B22D 17/2209* (2013.01); *B22D 19/0081* (2013.01); *C23C 28/321* (2013.01); *C23C 28/3455* (2013.01)

(58) Field of Classification Search

CPC ..... B22D 17/20; B22D 17/2023; B22D 17/2209; B22D 19/00; B22D 19/0081; C23C 28/321; C23C 28/3455

USPC ..... 164/14, 138, 75, 100, 113

See application file for complete search history.

(56) References Cited

U.S. PATENT DOCUMENTS 12,194,528 B2 * 1/2025 Han ..... C23C 28/321

* cited by examiner

*Primary Examiner* — Kevin P Kerns

(57) ABSTRACT

A process of forming an erosion, oxidation, and wear resistant shot chamber, either a gooseneck or a shot sleeve, is provided. The process utilizes a casting process for forming a one-piece shot chamber having a liner metallurgically bonded to the bulk portion of the shot chamber. Channels of predetermined shape and layout are built on the tubular external surface of the liner for facilitating thermal management of the shot chamber during die casting operations.

20 Claims, 8 Drawing Sheets

CASTING PROCESS FOR MAKING AN EROSION AND WEAR RESISTANT SHOT CHAMBER FOR DIE CASTING APPLICATIONS

CROSS-REFERENCE TO RELATED APPLICATIONS

The present U.S. patent application is a continuation-in-part application of U.S. patent No. 12,194,528 granted Jan. 14, 2025, and a continuation-in-part application of U.S. patent Ser. No. 11/577,304 granted Feb. 14, 2023. The relevant contents of this prior application are hereby incorporated by reference into the present disclosure.

FIELD OF THE INVENTION

The present invention relates to die casting, more specifically, to an erosion and wear resistant gooseneck and shot chamber for die casting of aluminum alloys.

BACKGROUND OF THE INVENTION

Die casting, also termed as high pressure die casting (HPDC), is a widely-used process that entails the injection of a molten metal into a die cavity under high pressure. The metal, commonly aluminum, magnesium, zinc, their alloys, and sometimes copper, titanium, and their alloys, is transported into a chamber containing a cylindrical channel connected to the die cavity, and then is injected with a piston from the chamber to the die cavity, where it solidifies and forms a solid component. Die casting is generally considered to be a cost-effective process capable of producing precision (net-shape) products at high production rates. Currently, die casting processes are used to produce over 70% of the annual tonnage of all aluminum castings in the United States.

There are two kinds of die casting processes: hot-chamber and cold-chamber die casting. An exemplary hot-chamber die casting process is illustrated in FIG. 1. The hot-chamber die casting process uses a "gooseneck" as the chamber containing a cylindrical channel connected to the die cavity. Part of the gooseneck is submerged into the molten metal in a pot or a holding furnace so that the chamber is hot. A reciprocating plunger in the cylindrical channel draws the molten metal in and injects it into the mold cavity through a nozzle. The injection system for hot-chamber die casting consists of a gooseneck, plunger, and a nozzle.

The cold-chamber process, shown in FIG. 2, involves pouring hot metal into a cold shot chamber or shot sleeve containing a cylindrical channel and injecting it using a ram or a plunger into the die cavity. The injection system for cold-chamber die casting consists of a plunger or ram, and a shot sleeve.

The internal surface of the chamber, either a gooseneck or a shot sleeve, is impacted by the corrosive hot metal as it is drawn in or poured in at relatively high speed. The plunger slides against the internal surfaces of the chamber at high temperatures as well. Consequently, the chamber at its internal surface suffers severe erosion by the corrosive molten metal and wear by the plunger. The chamber material, providing the internal surfaces of the chamber, has to withstand both erosion and wear. The internal surface is the working surface for such a chamber.

The present invention relates to minimizing erosion and wear of the shot chamber, and more broadly, for die tooling, including but not limited to the gooseneck, nozzle, shot sleeve, plunger, ladle, and inserts in die or mold including pins for forming holes in a casting. Die tooling components all have working surfaces in contact with the corrosive molten metal flowing over them at fairly high speeds.

Traditionally, die tooling is made of hot work steels. H13 steel is used widely in the United States. Shot sleeve is made of H13. A gooseneck is made of either cast iron or cast steel. These die tooling components are expensive to make. The service life of die tooling is vital to the competitiveness of the industry.

Erosion of the gooseneck in molten aluminum is so severe that hot chamber die casting process is not commercially used for making aluminum castings. Attempts have been made to use refractory ceramic materials for making the gooseneck. For example, U.S. Pat. No. 3,067,146 to Gottfried, U.S. Pat. No. 3,652,072 to Lewis, European Patent No. 0827793 to Miki et al, and Taiwan Patent Document No. 201529204 to Eguchi et al. disclose using ceramic goosenecks for aluminum die casting. However, hot-chamber aluminum die casting systems that utilize ceramic liners for the gooseneck or use ceramic materials for the entirety of the gooseneck have not found wide applications because of high financial costs and poor service life of the ceramic components. Ceramic materials conventionally used for such purposes have had issues with thermal fatigue. Also the relatively low tensile properties and brittleness of ceramic materials have resulted in goosenecks prone to damage during die casting operation. U.S. patent application Ser. No. 15/463,345 by Han et al. discloses the use of refractory metals for the liner in a gooseneck. No protection of the liner is discussed and no relationship between the liner and the bulk materials of the gooseneck is defined. A thin refractory metal liner without proper protection cannot survive long in an aggressive oxidation, erosion, and wear environment.

Refractory metals have high melting points and excellent thermal fatigue resistance. They are resistant to erosion [1-2] by molten aluminum but are vulnerable to rapid oxidation at elevated temperatures. At temperatures as low as 500° C., oxidation is significant. By 1100° C., the low oxidation resistance of refractory metals can preclude completely their use in air [3]. Also, the hardness of the refractory metals is much lower than H13 steel. Alloying of the refractory metals improves their hardness to some extent but minimally increases their corrosion resistance [4]. Liners used in the gooseneck have to be not only erosion resistant but also oxidation and wear resistant.

Erosion of steels in molten aluminum is also a severe issue in cold-chamber die casting [1, 5-7] where H13 steel is usually used for the shot chamber or shot sleeve of a one-piece structure. This is especially true for cold-chamber die casting of structural aluminum alloys because these alloys contain low iron content. Erosion of die tooling steels in molten aluminum can be reduced by lowering the temperature of the die tooling to a given temperature of the molten aluminum [5, 7]. However, there is an uneven or nonsymmetrical temperature distribution in the shot sleeve during die casting operation. When hot molten metal is poured into the shot sleeve, the portion of the shot sleeve under the pour hole is the hottest. Furthermore, the molten metal does not entirely fill the shot chamber but lies or pools along the bottom of the sleeve prior to the commencement of the forward plunger stroke. The portion of the shot sleeve in direct contact with the molten metal is hotter and erodes faster than the other portion of the shot sleeve. Uneven temperature distribution leads to uneven erosion and thermal distortion of the shot sleeve. To reduce uneven temperature distribution, holes are usually drilled into a shot sleeve to form channels that accommodate means of cooling or heating locally. The drilling operation is capable of only forming straight channels. Forming shapes of the channel other than a hole in a shot sleeve is desired but is not achievable.

To extend the service life of a shot chamber, interchangeable liner is used to form the working surface of the shot chamber of two-piece structure. The liner, if damaged by erosion or wear, can be replaced so that the bulk of the shot chamber can be reused.

U.S. Pat. No. 9,114,455 to Donahue et al discloses an improved shot sleeve cold-chamber for die casting of low-iron aluminum silicon alloys and a method for making the shot sleeve of a two-piece structure. The shot sleeve includes an erosion resistant liner that tightly fits with the bulk H13 steel within a small tolerance. The liner is selected from refractory metals including titanium, tungsten, molybdenum, ruthenium, tantalum, niobium etc. The shot sleeve made using this invention lasts longer than that of H13 but there are still a number of issues. The liners only tightly fit with the bulk steel in which there is no bond between them. Consequently, thermal distortion is an issue. Thick liners have to be used in order to reduce thermal distortion, but the refractory metals are expensive. Oxidation of the refractory metal liner is another issue. Metal loss on the internal surface of the liner opposite to the pour hole is observed. Such metal loss leads to dimension change as well. Furthermore, the low hardness of the refractory metal results in wear and scoring on the internal surface of the liner. Donahue et al. [8] report on the initial testing of niobium liners inserted into steel sleeves. Niobium is one metal that does not appear to dissolve in liquid aluminum [9-10] and should therefore better resist erosion and soldering. A casting trial indicated that the plunger tip experienced a higher level of wear which could be related to distortion of the liner and a loose clearance between the plunger tip and the sleeve liner [8-9].

There is a need to form channels of predetermined shapes for local cooling or heating in a shot chamber in order to achieve an optimal thermal management of the shot sleeve during die casting operation.

Therefore, there is also a need for developing an erosion, oxidation, and wear resistant die casting tooling, including gooseneck for hot-chamber die casting and shot sleeve for cold-chamber die casting applications. Erosion resistant liners are helpful in extending the service life of these die casting tooling. However, the liner surface should be oxidation, wear and erosion resistant. Furthermore, the liner has to be strongly bonded to the bulk material of the die casting tooling in order to avoid tooling distortion which causes excessive wear of the plunger tip and related operational issues.

SUMMARY OF THE INVENTION

In an exemplary embodiment of the present invention, a casting process of forming a low-cost, erosion, oxidation, and wear resistant shot chamber of a one-piece structure is provided wherein a metallic liner is metallurgically bonded to a ferrous alloy casted over the liner that is used as a core in molds in a casting process. Casting components are less expensive than wrought alloy components.

In another embodiment of the present invention, a casting process of forming an erosion, oxidation, and wear resistant shot chamber of a one-piece structure is provided wherein channels of desired shapes and layouts are prepared on the outer surface of a liner which is metallurgically bonded to the bulk of the shot chamber. These channels can be used for the thermal management of the shot sleeve by means of local cooling or heating in order to extend the service life of the shot chamber of a one-piece structure containing a metallic liner. Local cooling or heating can be achieved by passing a fluid or by placing heating elements in the channels.

In another embodiment of the present invention, a casting process of forming an erosion, oxidation, and wear resistant shot chamber, either a gooseneck or a shot sleeve, is provided. The process includes the steps of preparing a liner made of refractory metallic materials with melting temperatures higher than 1600° C., placing the liner in a mold cavity for use as a core for forming the working surfaces of the shot chamber, and pouring a ferrous liquid alloy into the mold cavity to bond the coated liner with a metallurgical bond and to form a solid composite shot chamber after the liquid alloy is solidified on the coated liner. Such a shot chamber produced using the present invention is of a one-piece structure and is expected to have a long service life and a minimal thermal distortion during its service for making die castings.

In another embodiment of the present invention, a casting process of forming an erosion, oxidation, and wear resistant shot chamber, either a gooseneck or a shot sleeve, is provided. The process includes the steps of preparing a liner made of refractory metallic materials with melting temperatures higher than 1600° C., coating the outer surface of the liner to facilitate the formation of a metallurgical bond with a selected ferrous alloy, coating the internal surface of the liner with a self-healing coating which has a metallurgical bond to the liner, placing the coated liner in a mold cavity to use it as a core for forming the working surfaces of the shot chamber, and pouring a ferrous liquid alloy into the mold cavity to bond the coated liner with a metallurgical bond and to form a solid composite shot chamber after the liquid alloy is solidified on the coated liner. Such a shot chamber produced using the present invention is of a one-piece structure and is expected to have a long service life and a minimal thermal distortion during its service for making die castings.

In another embodiment of the present invention, a casting process of forming an erosion, oxidation, and wear resistant shot chamber is provided wherein the liner material is a refractory metal or its alloys, including niobium, molybdenum, rhenium, tantalum, titanium, or tungsten, and their alloys. The liner is coated with a protective coating which consists of a metal, an alloy, a bonding agent such a solder, or compounds deposited on the liner using physical vapor deposition (PVD), chemical vapor deposition (CVD), hot dipping, thermal spray, or other surface deposition techniques.

In another embodiment of the present invention, a casting process of forming an erosion, oxidation, and wear resistant shot chamber is provided wherein the surface layer of the liner is a self-healing coating consisting of compounds which can be formed between the liner materials and the molten alloys being processed in the shot chamber. One of such self-healing coatings is an aluminide coating for die casting of aluminum alloys. Damaged coating can be repaired in-situ by the chemical reaction between the liner materials and the molten aluminum alloy being processed in the shot chamber.

DETAILED DESCRIPTION OF THE INVENTION

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

Prior art of fabricating shot chamber has issues with its service life. There are two types of shot chambers: a one-piece structure consisting of a single alloy and a two-piece structure consisting of an inner liner or insert and an outer layer of ferrous alloy wherein the liner is interchangeable and can be removed from the shot chamber if it is damaged. In the shot chamber of a two-piece structure, the liner is not bonded to the bulk of the shot chamber. The term "composite shot chamber" in the present invention refers to the shot chamber of a one-piece structure containing multi-layers wherein the layers are metallurgically bonded.

The shot chamber in a conventional cold-chamber die casting machine is a one-piece structure and is machined out of a rough chamber of wrought steel such as H13 steel. Wrought steels are difficult to cast and are generally more expensive than cast steels. Such a one-piece structured shot chamber made of a single material can be cost effectively replaced by a one-piece composite shot chamber described in the present invention.

Figure 3A:
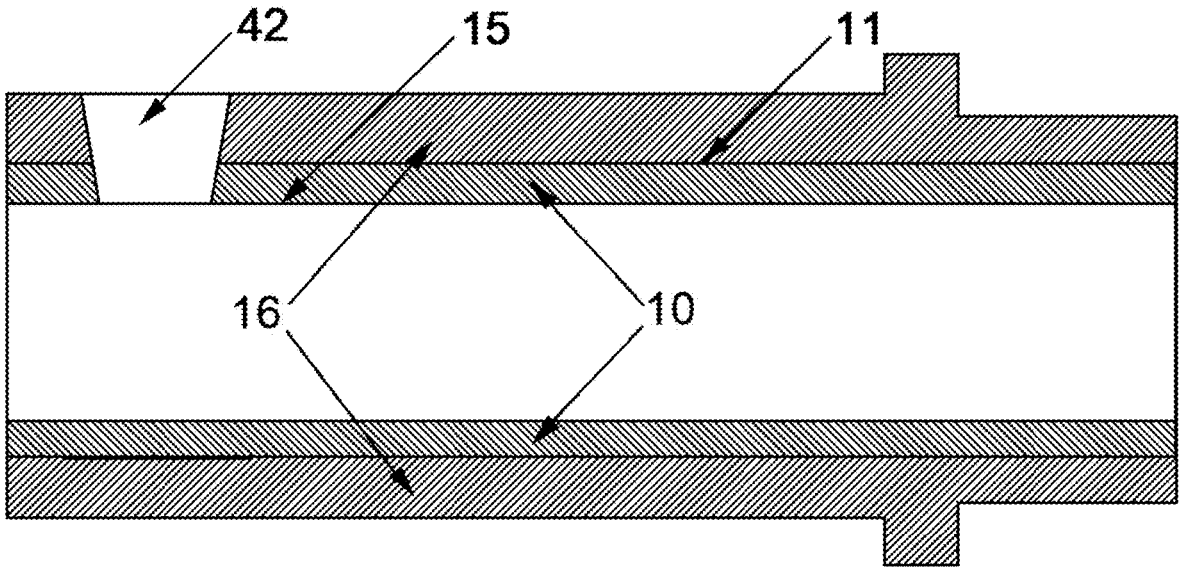
FIGS. 3A and 3B are schematic views of a layout of one embodiment of the present invention.

FIG. 3A illustrates schematically a shot chamber consisting of two layers: an outside layer 16 and an inner layer 10 which is also a liner 10. The liner 10 has a tubular external surface 11 and a tubular inner surface 15. The tubular liner 10 in the prior art fits with the outside layer 16 within a small tolerance (U.S. Pat. No. 9,114,455 to Donahue et al.), i.e., there is no bonding at the interface 11 between the outer layer 16 and the liner 10. The inner layer 10 can be a short liner forming only the internal surface of the shot chamber near the pour hole 42 or a tubular liner covering the entire internal surface of the shot chamber as illustrated in FIG. 3A. The outside layer 16 is usually made of H13 steel in the U.S. die casting industry. The liner 10 is made of H13 steel or a tungsten alloy. In order for the liner to withstand the thermal impact and the resultant thermal distortion, the thickness of the liner 10 is usually greater than an inch, and that of the outer layer is a few inches in the prior art.

In a preferred embodiment, the present invention deals with using an inner layer or liner 10 as a core and pouring a molten ferrous cast alloy over the liner 10 to form the outer layer 16 of the shot chamber. When the molten alloy contacts and then solidifies on top of the liner, it interacts with the surface materials of the liner at the interface 11, forming a metallurgical bond that bonds the liner 10 and the solidified outer layer 16 into a one-piece shot chamber as shown in FIG. 3A. Since the liner 10 is used as a core and the metallic liner 10 is not permeable to fluid, a fluid coolant or a heating agent can be applied to the inner surface 15 of the tubular liner 10 to control the development of the metallurgical bonds and microstructure formation on the external tubular surface of the liner when a molten metal is poured over the liner 10 during the casting process. Because the liner 10 is bonded metallurgically to the outer layer 16 at the tubular external surface 11, the liner 10 can be as thin as about 1 millimeter. The liner 10 can be made of a metallic alloy or a ceramic material with good resistance to erosion by molten metal and wear by plunger, dissimilar to the ferrous alloy used for making the outer layer of the shot chamber. Alloys suitable for making the liner include alloyed steels and refractory metallic alloys such as including niobium, molybdenum, rhenium, tantalum, titanium, or tungsten alloys. The liner 10 can also be made of a composite material consisting of a multi-layered structure wherein the internal layer of the liner 10 is made of a refractory material or a ceramic material while the outer layers include a ferrous alloy. The layers in the multi-layered structure are bonded. A metallized coating can be applied on the outer surface of the liner 10 to facilitate the metallurgical bonding at interface 11 between the outer layer 16 and the liner 10. The metallized coating includes, but is not limited to, aluminum alloys, zinc alloys, copper alloys, silver alloys, etc. The metallized coating is applied using hot plating, cementation-packing, laser-printing, thermal spring, arc surface alloying, or other techniques. During the casting operation, coolant can be applied in the internal surface of the liner tube for controlling the microstructure of the solidifying alloy. The inner layer 10 can be a short liner forming only the internal surface of the shot chamber near the pour hole 42 or a tubular liner covering the entire internal surface of the shot chamber.

The erosion resistance of a steel shot chamber to a molten aluminum alloy decreases substantially with increasing temperature [10]. Uneven temperature distribution in the shot chamber causes chamber distortion, resulting in wear or tear damage to the shot tooling. For thermal management of the shot chamber, channels are drilled into the shot chamber for local cooling or heating. The straight channels drilled into the shot chamber improve thermal management of the chamber but have their limitations in obtaining an optimal temperature distribution.

Figure 3B:
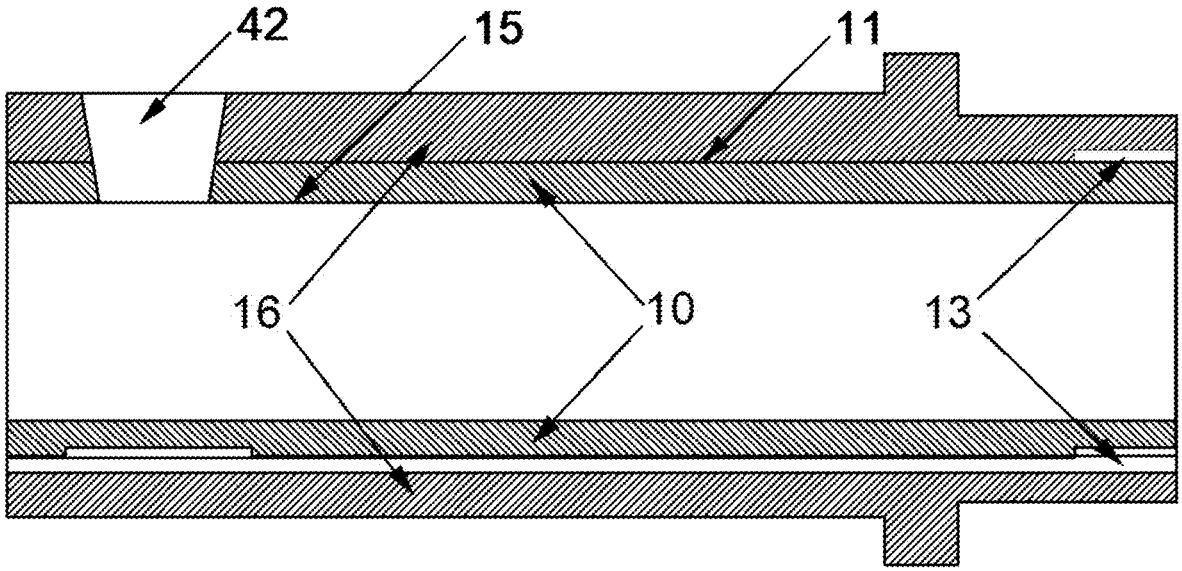
Figure 4A:
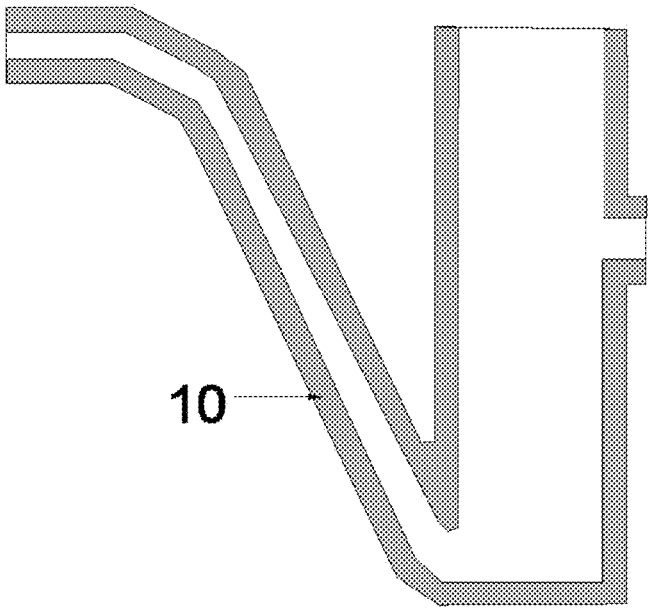
FIGS. 4A, 4B, 4C, 4D, and 4E are schematic views of a layout of one embodiment of the present invention.
Figure 4B:
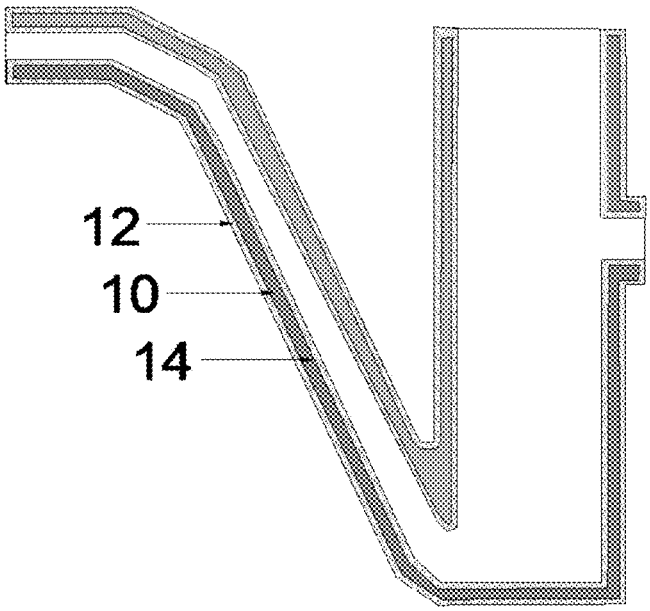
Figure 4C:
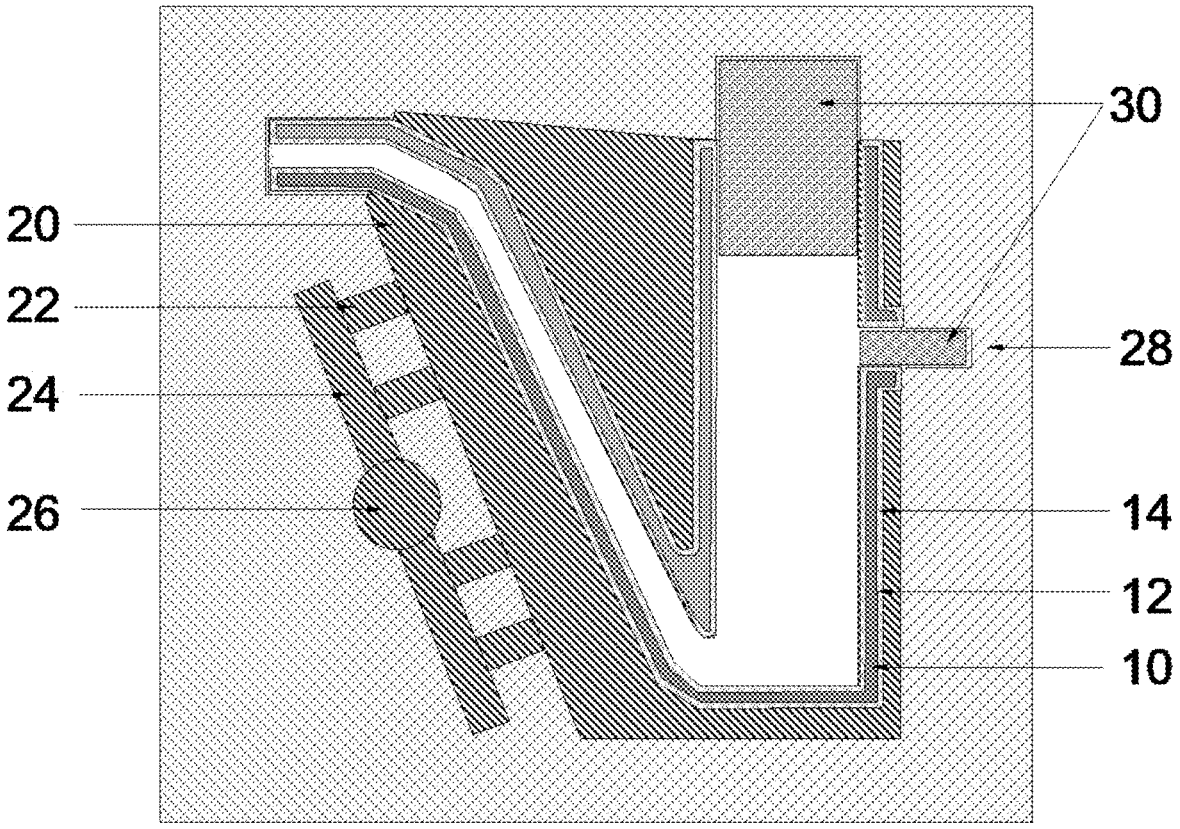
Figure 4D:
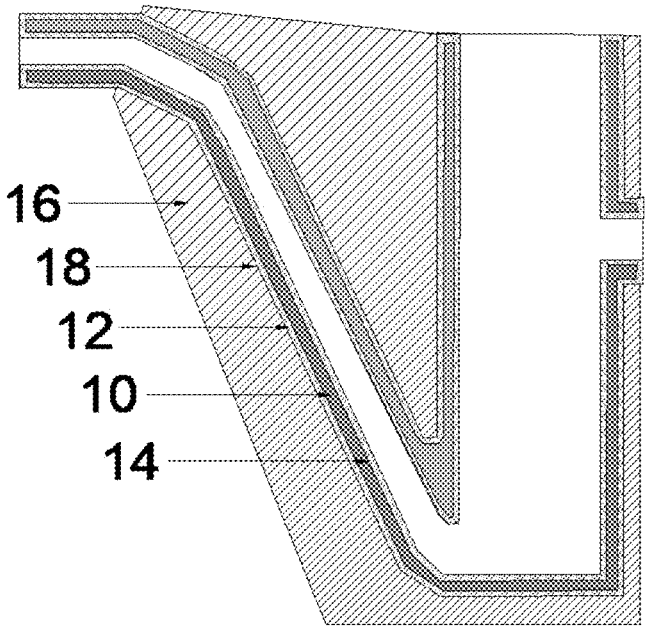
Figure 4E:
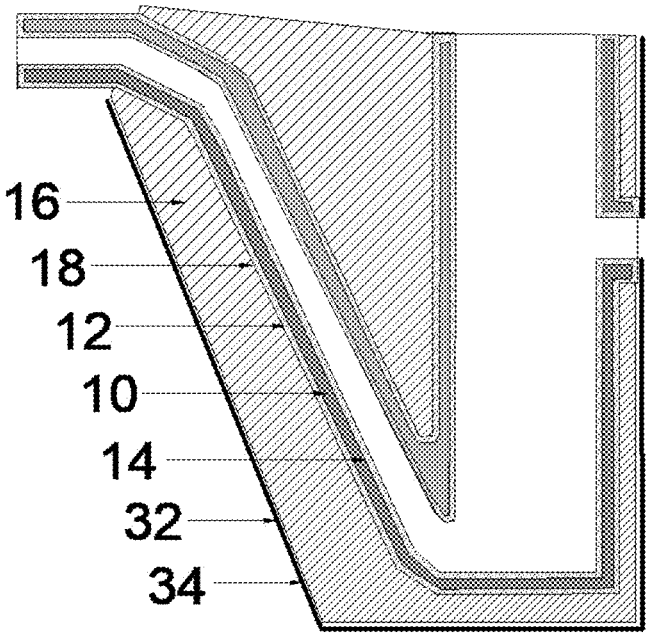
Figure 5A:
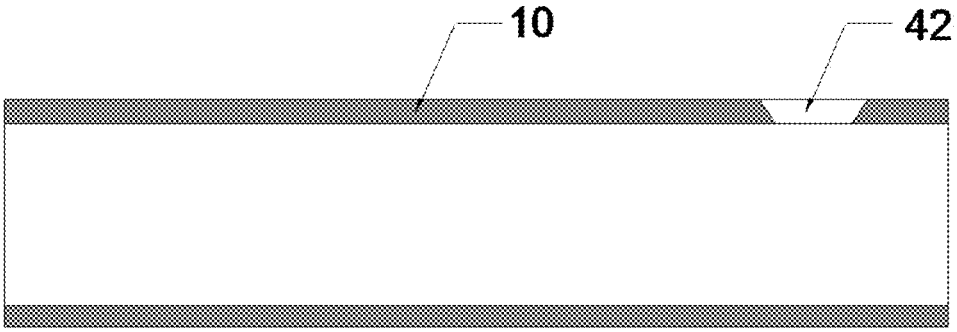
FIGS. 5A, 5B, 5C, and 5D are schematic views of a layout of one embodiment of the present invention.
Figure 5B:
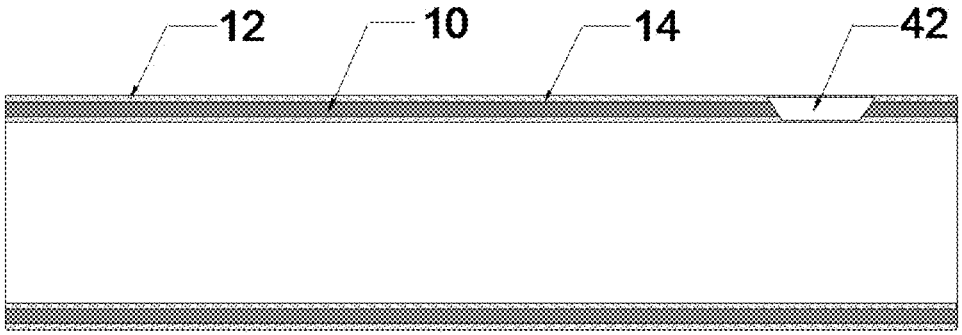
Figure 5C:
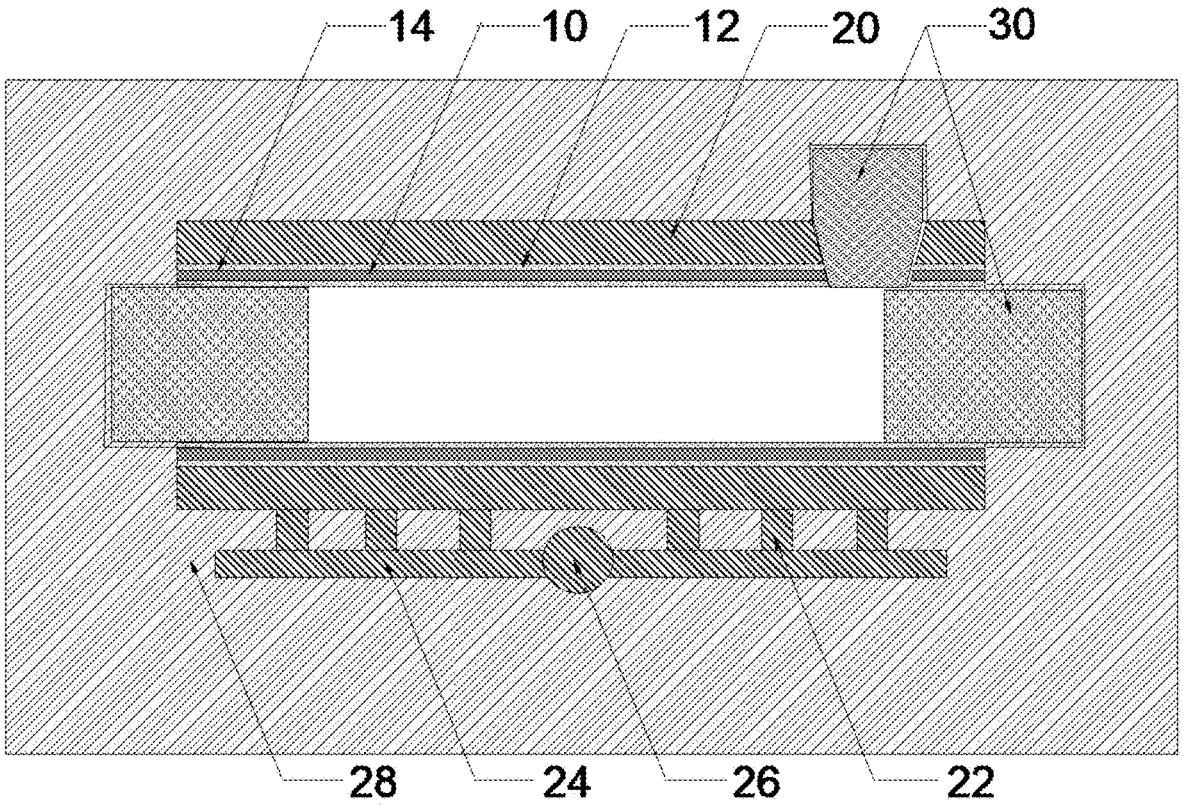
Figure 5D:
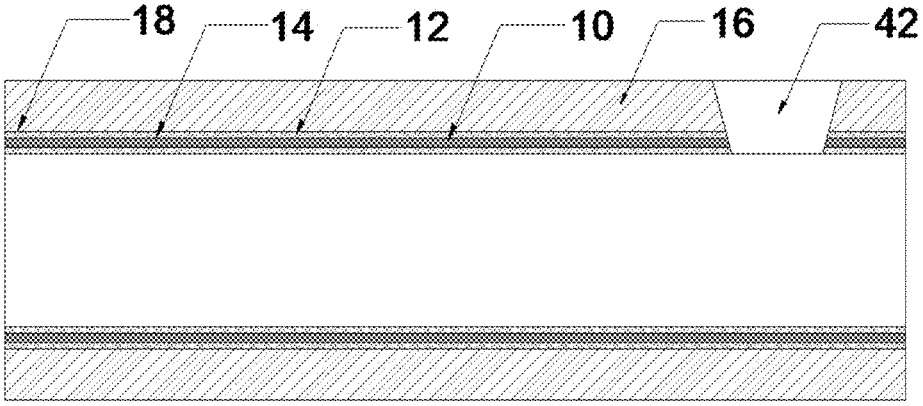

In another preferred embodiment, the present invention deals with using a liner to form the inner layer of a shot chamber and pouring a molten ferrous cast alloy over the liner to form the outer layer of the shot chamber that is metallurgically bonded to the liner as shown in FIG. 3B. The preparation of the outer layer 16 and the liner 10 is the same as that described above except that prior to the pouring operation, a channel 13 of a predetermined shape and layout can be built on the outer surface 11 of the liner 10. A number of such channels can be arranged on the tubular external surface 11 of the liner 10 to form an optimal layout of the channels 13 for thermal management of the shot chamber. The channel 13 can be built on the tubular external surface 11 of the liner 10 by conventional operation means including 1) machining grooves on the outer surface of the liner and covering the grooves with sheet metal, 2) welding sheet metal on the tubular external surface of the liner to form a channel cavity of a desired shape, and 3) using 3D printing to form a channel cavity of a desired shape. The liner 10 with channels 13 built on can be placed in casting molds as a core. Molten metal is then poured over the core to form the outer layer 16 of the shot chamber. A metallized coating can be applied on the external surface of the channel walls if metal is used for building the channel walls prior to the pouring of a molten ferrous alloy. The use of a metallized coating is to facilitate the formation of metallurgical bonds between the channel wall and the ferrous metal poured over it. The metallized coating includes, but is not limited to, aluminum alloys, zinc alloys, copper alloys, silver alloys, etc. Water-soluble sand cores can also be used on the outer surface of the liner to form the channel 13. Since the liner 10 is used as a core and the metallic liner 10 is not permeable to fluid, a fluid coolant or heating agent can be applied to the inner surface 15 of a tubular liner 10 to control the development of metallurgical bonds and microstructure formation on the external tubular surface of the liner when a molten metal is poured over the liner 10 during the casting process. After the molten ferrous alloy is solidified on the liner 10 with the water-soluble cores, the cores can be removed by water so that channels of a predetermined shape and layout are formed in the composite shot chamber. The benefit of the present invention as illustrated in FIG. 3B is that channels 13 of a predetermined shape and layout can be conveniently built on the outer surface 11 of the liner 10 prior to casting to form a one-piece composite shot chamber. A fluid at a predetermined temperature can then be transported through selected channels for local cooling or heating. Heating elements can also be placed in selected channels for local heating. Such a shot chamber provides means for optimal thermal management of the shot chamber and thus enhancing the service life of the shot chamber and improving the internal quality of die castings made thereof. The fluid suitable for thermal management includes, but is not limited to water, oil, ionic liquid, metallic liquid, mineral liquid, gases, or a mixture of these fluids.

The present invention shown in FIG. 3 allows the use of a thin liner in a one-piece composite shot chamber, which is beneficial not only for improved thermal management but also for reducing the costs of the shot chamber, especially if refractory metals are used for making the liner of the shot chamber.

Recently, thick refractory metal liners have been used in a two-piece shot chamber (U.S. Pat. No. 9,114,455 to Donahue et al.). The service life of a refractory metal liner is much longer than that of H13 steel liner. However, there are also issues associated with the refractory metals.

Refractory metals usually have a poor oxidation resistance [3-4]. Two niobium lined shot sleeves were made according to U.S. Pat. No. 9,114,455 to Donahue et al. One shot sleeve was used for over 6,000 cycles which last longer than H13 shot sleeves, but a dent was formed on the inside surface of the shot sleeve opposite to the pour hole where the molten metal impinged the shot sleeve surface. Erosion did not appear to happen at this area, so the mass loss was most likely due to oxidation. Thermal distortion was another issue. The liner was shrunk fit into the sleeve. There was no bonding between the liner and the H13 steel sleeve. During casting trials, the liner deformed, leading to high level of wear of the liner and the plunger tip.

In another preferred embodiment, the present invention relates to a method for forming an erosion, oxidation, and wear resistant shot chamber for die casting applications. The erosion and wear resistance of the shot chamber are provided by a self-healing coating on the surfaces of a refractory metallic alloy liner. The term "self-healing coating" refers to a coating that, if damaged, can be repaired in-situ by chemical reactions between the liner materials and the molten alloy processed in the chamber, forming similar or dissimilar compounds to that of the original coating on the damaged sites. The purpose of using an initial coating on the refractory metal liner is to protect the liner from oxidation during its fabrication process before the liner is in contact with liquid metal. The initial coating can be damaged by the molten metal in the chamber with the liner. However, as long as the damaged site can be filled or replaced immediately by newly formed materials due to the chemical reaction between the molten metal and the materials on the surface of the liner, a protective layer of coating is formed on the surface of the liner. By such a definition of the self-healing coating, coatings that are suitable for protecting refractory metals from oxidation may be used as the initial coating on the refractory liner. These coatings include but are not limited to silicide and nitride coating, hot dipping and plating of various metals and alloys such as aluminum alloy, tin, silver, and zinc alloy, laser printing of metals and alloys, arc surface alloying, spray forming of metals and alloys, PVD and CVD of compounds.

For a liner made of niobium, tungsten, molybdenum, titanium, and their alloys, aluminizing coating is one of the preferred surface coatings. This is because aluminizing produces a metallurgical bond between the refractory metal liner and aluminides. The bond consists of line compounds at the interface between a refractory metal and molten aluminum. These line compounds have high melting temperatures and thus are resistant to erosion and soldering by molten aluminum [5]. As a line compound, its composition falls within a very narrow range as diffusion of elements across this compound becomes difficult because composition difference is the driving force for elemental diffusion and erosion is a diffusion-controlled process. Furthermore, the line compound usually has high hardness which is good in resisting wear in the shot chamber by the plunger. Niobium, for instance, reacts with molten aluminum and forms a line compound, $NbAl_3$. The melting temperature of this compound is 1760° C., much higher than the melting temperature of aluminum (660° C.). Aluminum at the external surface of the compound is resistant to oxidation at elevated temperatures. This line compound, if damaged on the liner surface, can be replaced in-situ with newly formed line compounds in the next cycle of die casting when the liner is in contact with molten metal. Aluminum metal can be deposited on niobium alloys (or molybdenum and its alloys) using hot dipping, chemical vapor deposition, laser printing, fused salt processes, and physical vapor deposition. Aluminum deposited on the refractory metal can then heat treated to improve the formation of aluminides.

In another preferred embodiment, the present invention relates to a method for forming an erosion, oxidation, and wear resistant shot chamber for die casting applications. The surface coated liner is placed in a mold cavity as a core, or part of a core, for forming the working surfaces of the shot chamber. Molten steel or cast iron is then poured into the mold cavity, reacts with the surface materials of the liner, cools and solidifies on the liner, and form a composite shot chamber with a metallurgical bond between the ferrous material and surface material of the liner. Thus, in addition to protecting the liner from oxidation in air and erosion in molten metal during die casting, another purpose of using the coating on refractory metal liners is to encourage the chemical reaction between the liner material and the bulk ferrous material. The coating can serve as the material for forming the metallurgical bond with the ferrous material or serve as a sacrificial layer to protect the surface of the liner before the liquid ferrous material contacts the solid liner material. Refractory metals such as niobium can readily react with ferrous material to form metallurgical bond if the surface of the liner is free from oxidation.

For hot-chamber die casting, castings of composite gooseneck consisting of refractory metallic alloy liner, or even ceramic liner, has not been tested in the past. This is partly due to the fact that conventional refractory materials are ceramic materials that are not capable of withstanding the thermal shock of contacting molten ferrous alloys such as steels and cast irons. Refractory metals, such as niobium alloys, experience rapid oxidation at temperatures above 400 to 500° C. By 1100° C., the low oxidation resistance of refractory metals can completely preclude their use in air [3-4]. Therefore, according to conventional wisdom, it is unreasonable to cast liquid iron or steel, usually at temperatures of above 1300° C., on niobium alloys. Furthermore, niobium has been an alloying element added in molten cast iron or steel to improve their mechanical properties, indicating that niobium can readily dissolve into molten ferrous alloys. Such a phenomenon prevents people from attempting to cast a composite gooseneck containing a thin liner of refractory metal. The method of this invention is novel. It discloses the idea of utilizing the reaction of the liner materials with the bulk materials during casting to form a metallurgical bond that strongly joins the liner to the bulk material as a whole one-piece gooseneck.

For cold-chamber die casting, conventional methods for fabricating a shot sleeve with a refractory metal liner involve using a rough chamber of wrought H13 steel, machining to expand a portion of its internal diameter, and inserting the liner tightly into the shot sleeve. The liner has to be thick enough to reduce thermal distortion during its service because the liner is not bonded to the bulk material of the chamber. Refractory metals are expensive, so the use of a thick refractory metal increases the costs of the chamber substantially. A shot sleeve with a niobium liner was built and tested [8-9]. After this shot sleeve was used for around 300 shots or cycles, the liner was pushed towards the dies/molds due to its plastic deformation, leaving a gap at the ram end. Such a gap decreases the service life of the ram. It is also a safety concern. Another issue is the low hardness of the refractory liner which leads to severe wear of the liner during service. Furthermore, premium H13 steel with strict heat treatment procedures has to be used as the bulk material for the chamber. H13 steel is also more expensive than conventional high strength cast steels.

This invention teaches the use of refractory metal liner with a strong metallurgical bond to the bulk material of the shot chamber. The thermal shock of the molten metal during die casting is applied on the refractory metal liner. The bulk material of the chamber, which is buffered by the liner, is not in direct contact with the molten metal and thus experiences much less thermal shock. As a result, the present invention enables the use of low cost steels with higher strength but lower thermal shock resistance than the bulk materials for the shot sleeve. The present invention also teaches the use of a "self-healing" wear resistant coating that has a metallurgical bond to the refractory liner. Such a coating, if damaged, can be repaired in-situ by chemical reactions between the molten metal and the liner. The molten metal is likely to fill the damaged sites on the liner. The filled metal will have enough time to react with the liner materials during the following cycles of die casting operations. The reaction products between the liner material and the molten metal are intermetallics. These intermetallic phases are hard enough to resist wear by the plunger and erosion by the molten metal.

Figure 1:
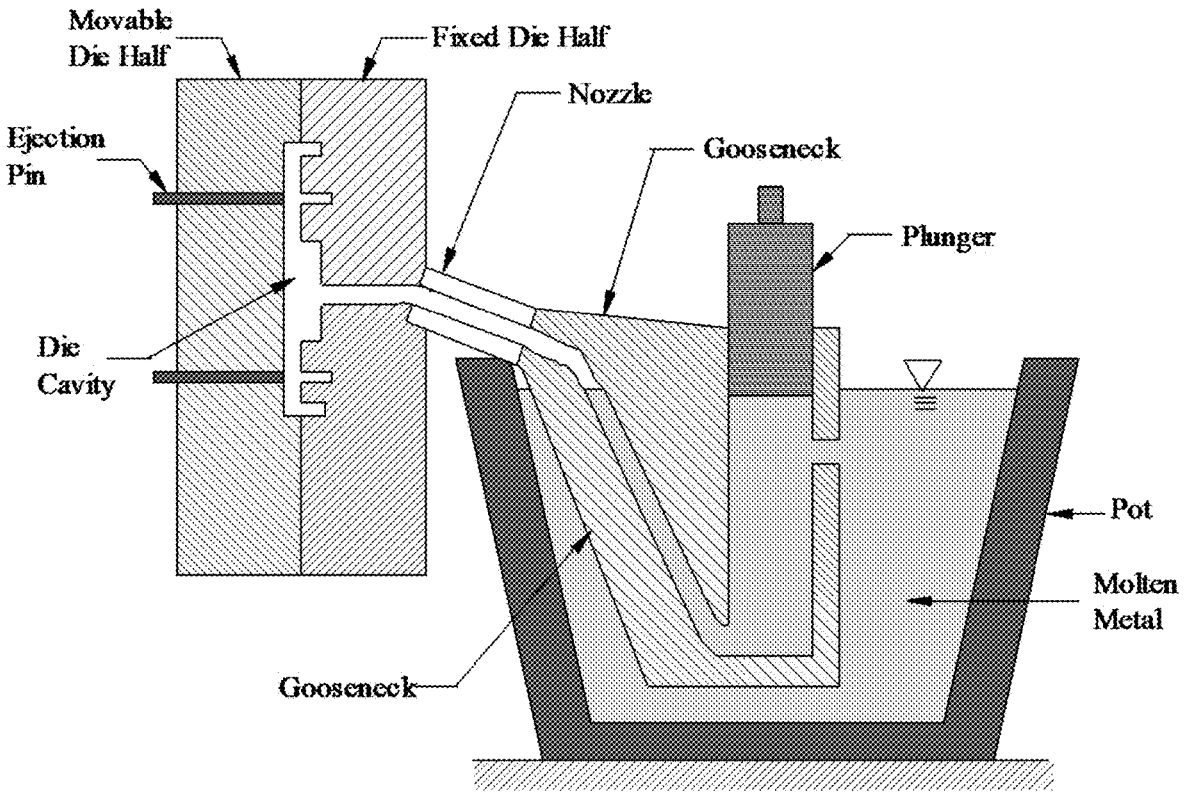
FIG. 1 Prior Art
FIG. 1 schematically represents a hot-chamber die casting process and die tooling associated with the process.

FIG. 4 schematically illustrates a preferred method for forming an erosion, oxidation, and wear resistant shot chamber or gooseneck shown in FIG. 1 for the hot-chamber die casting process. A thin liner of refractory metallic alloy 10 (with or without channels as shown in FIG. 3B) is prepared (FIG. 4A) and coated with an oxidation resistant coating 12 (FIG. 4B). The coating 12 is selected such that a metallurgical bond is formed at the interface 14 between the liner 10 and the coating material 12. The coated liner is then placed in the cavity of mold 28. Cores 30 are used to support the liner 10 in the mold 28, shown in FIG. 4C. A molten ferrous alloy 20 is then poured on the coated liner 10 through downsprue 26, runner 24, and gates 22 to fill the remaining portion of the mold cavity, forming the bulk part of the gooseneck after the molten ferrous alloy is solidified on the liner 10. By removing the gating system consisting of the downsprue 26, runner 24, and gates 22, a solid composite gooseneck is made, shown in FIG. 4D. The composite gooseneck made using this invention has a metallurgical bond at the interface 18 between the bulk ferrous alloy 16 and the coated liner 10 & 12, and at the interface 14 between the refractory metal liner 10 and the coating material 12. Finally, another coating 32 is applied on the external surface 34 of the ferrous alloy 16 to protect the ferrous alloy 16 from erosion in molten metal, shown in FIG. 4E. The coating 32 can be any coating conventionally used in the permanent mold casting process for protecting the permanent molds. The coating 32 can also be any coating that is conventionally used in the die casting industry for protecting dies, inserts, and pins. The coating 32 can also be refractory metal coating or just simply a layer of refractory sheet metal bonded to the outside surface of the gooseneck contacting the molten metal.

Figure 2:
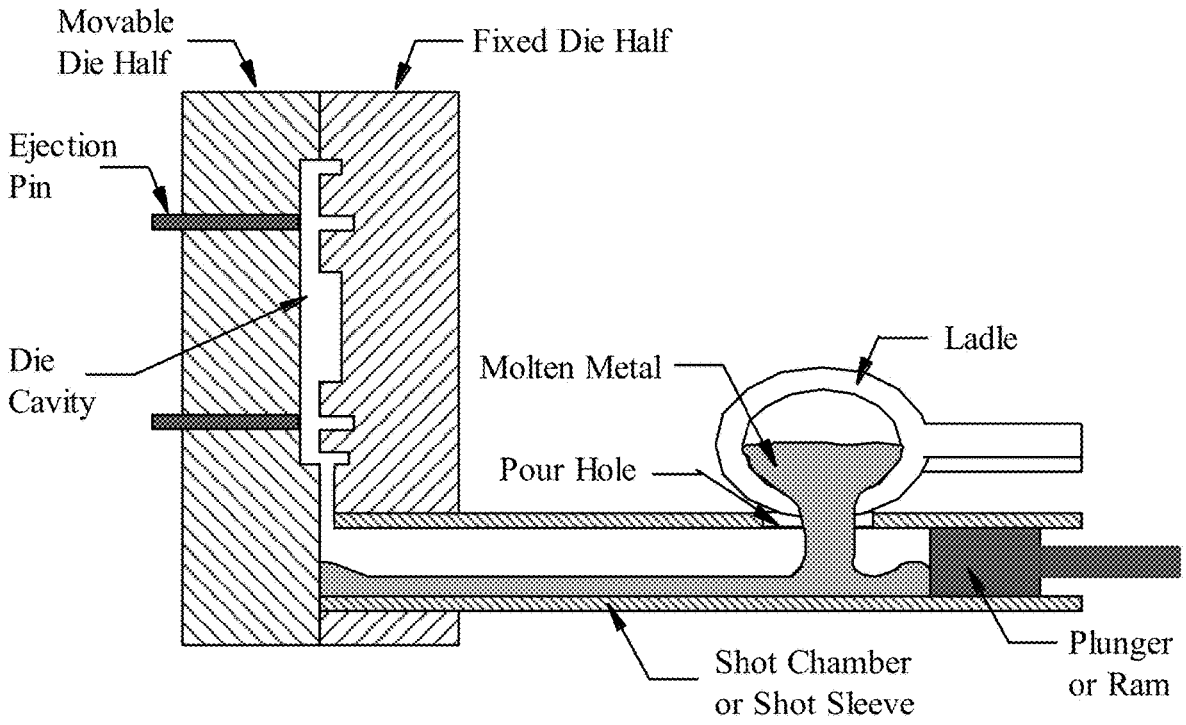
FIG. 2 Prior Art
FIG. 2 schematically represents a cold-chamber die casting process and die tooling associated with the process.

FIG. 5 schematically illustrates a preferred method for forming an erosion, oxidation, and wear resistant shot chamber or shot sleeve shown in FIG. 2 for the cold-chamber die casting process. A thin liner of a refractory metallic alloy 10 (with or without channels as shown in FIG. 3B) with a pour hole 42 is prepared (FIG. 5A) and coated with an oxidation resistant coating 12 (FIG. 5B). The coating 12 is selected and applied such that a metallurgical bond is formed at the interface 14 between the liner 10 and the coating material 12. The coated liner is then placed in the cavity of mold 28, shown in FIG. 5C. Cores 30 are used to support the coated liner 10 in the mold 28. A molten ferrous alloy 20 is then poured on the coated liner 10 through the downsprue 26, runner 24, and gates 22 to fill the remaining portion of the mold cavity, forming the bulk part of the shot chamber after the molten ferrous alloy is solidified on the liner 10. By removing the gating system consisting of the downsprue 26, runner 24, and gates 22, a solid composite shot chamber is made, shown in FIG. 5D. The composite shot sleeve made using the present invention has a metallurgical bond at the interface 18 between the bulk ferrous alloy 16 and the coated liner 10 & 12, and at the interface 14 between the refractory metal liner 10 and the coating material 12. Because the liner 10 is strongly bonded to the bulk ferrous alloy 16 and the liner 10 will be in contact with the high temperature molten metal, the bulk ferrous alloy 16 will be working at much lower temperatures and with much smaller thermal shock. As a result, a large number of high strength steels or cast irons can be selected for replacing premium H13 steel for building a shot sleeve.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. J. Song, T. DenOuden, and Q. Han, "Soldering Analysis of Core Pins", *NADCA Transactions* 2011, T11-062.

2. Z. Liu, Q. Han, and J. Li, "Ultrasound Assisted in situ Technique for the Synthesis of Particulate Reinforced Aluminum Matrix Composites," *Composites Part B: Engineering, vol.* 42, 2011, pp. 2080-2084.
3. C. L. Briant, "The properties and Uses of Refractory Metals and Their Alloys," *High Temperature Silicides and Refractory Alloys*, C. L. Briant et al. eds., Materials Research Society Symposium Proceedings, vol. 322, 1994, pp. 305-314.
4. J. B. Lambert, "Refractory Metals and Alloys," ASM Handbook, vol.2, 1990, pp.557-565.
5. Q. Han, and S. Viswanathan, "Analysis of the Mechanism of Die Soldering in Aluminum Die Casting", *Metallurgical and Materials Transaction A, vol.* 34A, (2003), pp. 139-146.
6. Y. Chu, P. Cheng, and R. Shivpuri "A Study of Erosive Wear in Die Casting Dies: Surface Treatments and Coatings," *NADCA Transactions* 1993, pp.361-371.
7. Q. Han, "Mechanism of Die Soldering during Aluminum Die Casting," *China Foundry, vol.* 12 (2), (2015), pp. 136-143.
8. R. Donahue, S. Knickel, P. Schneider, M. Witzel, J. Melius, and A. Monroe, "Performance of Shot Sleeve with Different Refractory Metal Liners in Casting of Structural Aluminum Die Casting Alloy 362", *NADCA Transactions* 2014, T14-011.
9. R. Donahue, "Avoiding Washout in Shot Sleeve When Used with Low Iron, Structural Aluminum Die Casting Alloys", *NADCA Transactions* 2013, T13-051.
A. B. William, and S. Midson, *Shot System Components User's Guide, NADCA* Publication: 525, NADCA 2016.
10. Q. Han, C. Vian, and J. Good, "Application of Refractory Metals to Facilitate Hot Chamber Aluminum Die Casting", International Journal of Metalcasting, vol. 15 (2), pp. 411-416.

What is claimed is:

1. A method for forming an erosion, oxidation, and wear resistant composite shot chamber for die casting operations, the method comprising the steps of:

preparing a liner of a metallic alloy with a minimum wall thickness of about 1 mm as an internal layer of said composite shot chamber, the liner having a tubular external surface and a tubular inner surface;

placing the liner in a mold cavity and using the liner as a core for forming an outer layer of said composite shot chamber;

pouring a ferrous liquid alloy into the mold cavity to form the outer layer of said composite shot chamber, the outer layer bonding the liner by metallurgical bonds at the tubular external surface of the liner and forming a solid said composite shot chamber during a pouring and solidification stage of such a casting process; and machining the solid said composite shot chamber to its final dimensions, wherein said outer layer and said liner are joined together to form said composite shot chamber of a one-piece (unitary) construction.

2. A method of claim 1 further comprising a step of coating the tubular external surface of the liner with a coating to facilitate formation of metallurgical bonds between the liner and the outer layer of said composite shot chamber.

3. A method of claim 2, wherein said coating is a metallized coating formed by means including hot plating, cementation-packing, laser-printing, thermal spraying, and arc surface alloying.

4. A method of claim 1, wherein the liner is made of an alloy including a steel and a refractory metallic alloy selected from a group of alloys including niobium, molybdenum, rhenium, tantalum, or tungsten alloys.

5. A method of claim 1, wherein the liner is made of a multi-layered structure with its inner layer made of a refractory metallic alloy or a ceramic material and its outer layer made of a ferrous alloy, the layers being bonded to form a unitary liner.

6. A method of claim 1, wherein a fluid at a predetermined temperature is applied on the tubular inner surface of the liner during the casting process to control bonding and microstructure formation.

7. A method for forming an erosion, oxidation, and wear resistant composite shot chamber for die casting operations, the method comprising the steps of:

preparing a liner of a metallic alloy with a minimum wall thickness of about 1 mm as an internal layer of said composite shot chamber, the liner having a tubular external surface and a tubular inner surface;

building at least one channel of a predetermined shape and layout on the tubular external surface of the liner;

placing the liner with said at least one channel in a mold cavity and using the liner as a core for forming an outer layer of said composite shot chamber;

pouring a ferrous liquid alloy into the mold cavity to form the outer layer of said composite shot chamber, the outer layer bonding the liner by metallurgical bonds at the tubular external surface of the liner and forming a solid said composite shot chamber during a pouring and solidification stage of such a casting process; and machining the solid said composite shot chamber to its final dimensions, wherein said composite shot chamber consists of multi-layered materials, is of a one-piece (unitary) construction, and contains the at least one channel for passing a fluid or for placing heating elements for thermal management of said composite shot chamber during die casting operations.

8. A method of claim 7 further comprising a step of coating the tubular external surface of the liner with a coating to facilitate formation of the metallurgical bonds between the liner and the outer layer of said composite shot chamber.

9. A method of claim 8, wherein said coating is a metallized coating formed by means including hot plating, cementation-packing, laser-printing, thermal spraying, and arc surface alloying.

10. A method of claim 7, wherein the metallic liner is made of an alloy including a steel and a refractory metallic alloy selected from a group of alloys including niobium, molybdenum, rhenium, tantalum, titanium, or tungsten alloys.

11. A method of claim 7, wherein the liner is made of a multi-layered structure with its inner layer made of a refractory metallic alloy or a ceramic material and its outer layer made of a ferrous alloy, the layers being bonded to form a unitary liner.

12. A method of claim 7, wherein the tubular inner surface of a refractory metallic liner is coated with a self-healing coating prior to or after the casting process.

13. A method of claim 12, wherein said self-healing coating is a metallized coating formed by means including hot plating, cementation-packing, laser-printing, thermal spraying, and arc surface alloying.

14. A method of claim 12, wherein the coating on the liner is a carbide, nitride, silicide, or a titanium aluminum nitride coating that is applied using means including a cementation-packing process, a physical vapor deposition process, or a chemical vapor deposition process.

15. A method of claim 7, wherein a fluid at a predetermined temperature is applied on the tubular inner surface of the liner during the casting process to control bonding and microstructure formation.

16. A method of claim 7, wherein a building means includes welding sheet metal of a desired shape to form said at least one channel on the tubular external surface of the liner.

17. A method of claim 7, wherein a building means includes using 3D printing to form the at least one channel on the tubular external surface of the liner.

18. A method of claim 7, wherein a building means includes machining the at least one channel on the liner and covering said at least one channel with a sheet metal to form the at least one channel on the tubular external surface of the liner.

19. A method of claim 7, wherein a building means includes using water-soluble cores of a desired shape to form the at least one channel on the tubular external surface of the liner.

20. A method of claim 7, wherein the fluid for thermal management of said composite shot chamber includes water, oil, ionic liquid, metallic liquid, mineral liquid, gases, or a mixture of two or more thereof.

* * * * *